US011131172B2

(12) United States Patent
Lin et al.

(10) Patent No.: US 11,131,172 B2
(45) Date of Patent: Sep. 28, 2021

(54) METHOD FOR EXTRACTING GAS BY FRACTURING COAL SEAM THROUGH COMBINATION OF HYDRAULIC SLOTTING AND MULTI-STAGE COMBUSTION IMPACT WAVE

(71) Applicants: China University of Mining and Technology, Jiangsu (CN); XUZHOU BOAN SCIENCE & TECHNOLOGY DEVELOPMENT CO., LTD, Jiangsu (CN)

(72) Inventors: Baiquan Lin, Jiangsu (CN); Yang Zhao, Jiangsu (CN); Wei Yang, Jiangsu (CN); Qingzhao Li, Jiangsu (CN)

(73) Assignees: China University of Mining and Technology, Jiangsu (CN); Xuzhou Boan Science & Technology Development Co., Ltd, Jiangsu (CN)

( * ) Notice: Subject to any disclaimer, the term of this patent is extended or adjusted under 35 U.S.C. 154(b) by 0 days.

(21) Appl. No.: 16/759,733

(22) PCT Filed: Oct. 29, 2018

(86) PCT No.: PCT/CN2018/112293
§ 371 (c)(1),
(2) Date: Apr. 28, 2020

(87) PCT Pub. No.: WO2019/242191
PCT Pub. Date: Dec. 26, 2019

(65) Prior Publication Data

US 2021/0148205 A1 May 20, 2021

(30) Foreign Application Priority Data

Jun. 22, 2018 (CN) ..... 201810653556.9

(51) Int. Cl.
*E21B 43/26* (2006.01)
*E21B 43/247* (2006.01)
(Continued)

(52) U.S. Cl.
CPC ..... *E21B 43/247* (2013.01); *E21B 43/006* (2013.01); *E21B 43/168* (2013.01); *E21B 43/26* (2013.01); *E21B 43/2605* (2020.05)

(58) Field of Classification Search
None
See application file for complete search history.

(56) References Cited

U.S. PATENT DOCUMENTS 4,537,256 A * 8/1985 Beard ..... E21B 43/263 166/177.2
2013/0341026 A1* 12/2013 Alifano ..... E21B 36/02 166/299

(Continued)

FOREIGN PATENT DOCUMENTS

CN 104314606 1/2015
CN 104612746 5/2015

(Continued)

OTHER PUBLICATIONS

"International Search Report (Form PCT/ISA/210) of PCT/CN2018/112293," dated Feb. 3, 2019, with English translation thereof, pp. 1-4.

*Primary Examiner* — Andrew Sue-Ako
(74) *Attorney, Agent, or Firm* — JCIPRNET

(57) ABSTRACT

A method for extracting gas by fracturing a coal seam through a combination of hydraulic slotting and multi-stage combustion impact wave comprises cutting slots in an impact borehole using a hydraulic slotting equipment to perform pressure relief and permeability enhancement on a coal seam and enlarge a $N_2$ (nitrogen gas) or $CO_2$ (carbon dioxide gas) storage space, injecting a large amount of $N_2$ or $CO_2$ into the borehole by means of a high pressure gas cylinder and a pressure reducing valve through a gas injection and extraction pipe, then injecting a certain amount of methane and dry air into a high-temperature and high-pressure combustion chamber by means of the high pressure gas cylinder and the pressure reducing valve, so that the (Continued)

gases are mixed and combusted to form high-temperature and high-pressure impact wave to push a piston to compress the $N_2$ or $CO_2$, thereby generating a large number of factures on the coal seam around the impact borehole under guiding action of the slots. The impact wave is repeatedly generated to form a multi-stage impact, and the impact of the next stage is based on the impact of the previous stage, so that the fractures on the coal seam around the borehole are further expanded and run through. After the $N_2$ or $CO_2$ is compressed by means of the multi-stage impact, more fracture networks are formed on the coal seam around the borehole under the guiding action of the slots and the fractures, thereby enhancing the borehole-based efficient gas extraction.

6 Claims, 1 Drawing Sheet

(51) Int. Cl.
*E21B 43/00* (2006.01)
*E21B 43/16* (2006.01)

(56) References Cited

U.S. PATENT DOCUMENTS

2014/0060831 A1* 3/2014 Miller ..... C09K 8/66
166/280.1
2014/0290956 A1* 10/2014 Burnette ..... F02B 71/045
166/308.1

FOREIGN PATENT DOCUMENTS

CN 105507938 4/2016
RU 2211920 9/2003
RU 2547892 4/2015

* cited by examiner

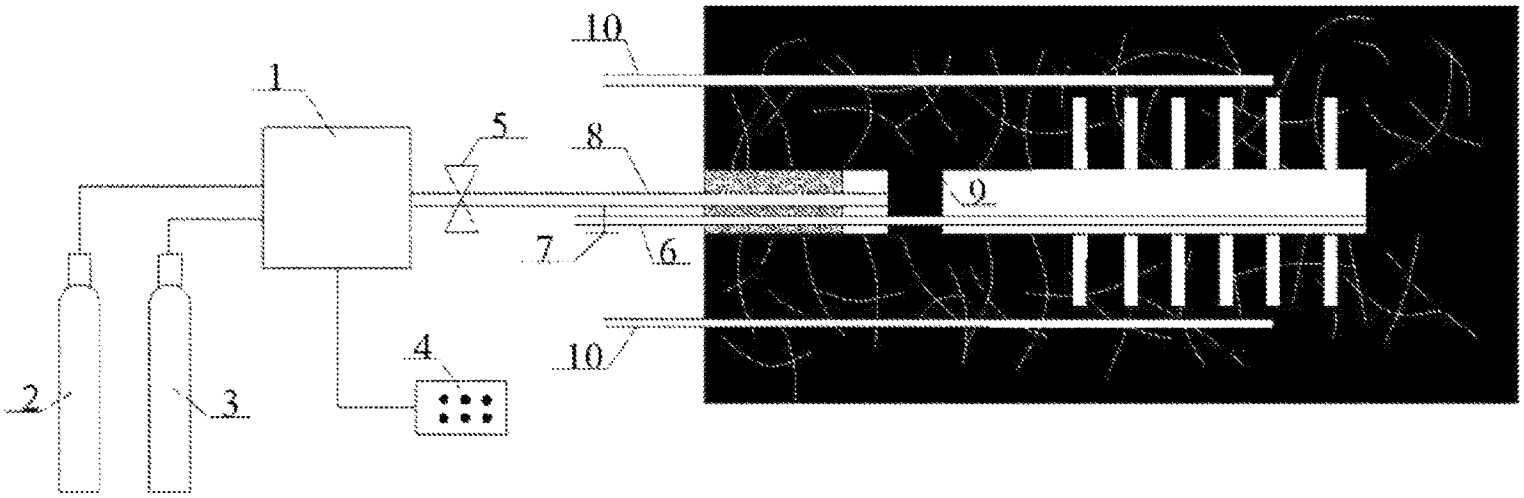
1
2
3
4
5
6
7
8
9
10
10

METHOD FOR EXTRACTING GAS BY FRACTURING COAL SEAM THROUGH COMBINATION OF HYDRAULIC SLOTTING AND MULTI-STAGE COMBUSTION IMPACT WAVE

CROSS-REFERENCE TO RELATED APPLICATION

This application is a 371 of international application of PCT application serial no. PCT/CN2018/112293, filed on Oct. 29, 2018, which claims the priority benefit of China application no. 201810653556.9, filed on Jun. 22, 2018. The entirety of each of the above mentioned patent applications is hereby incorporated by reference herein and made a part of this specification.

FIELD OF THE INVENTION

The present invention relates to coal seam fracturing and gas extraction, and in particular to a method for extracting gas by fracturing a coal seam through a combination of hydraulic slotting and multi-stage combustion impact wave.

DESCRIPTION OF RELATED ART

Along with increase of energy demand and mining intensity, coal mining depth is gradually increased. Deep coal seams have the characteristics of high ground stress, high gas pressure, high gas content and low permeability, and the cross coupling effect of all factors causes frequent deep mine disasters. Coalbed methane is one of major factors causing deep mine dynamic disaster, the global coalbed methane reserve reaches about 250 trillion cubic meters. Coalbed methane is not only a high-efficiency clean energy, but also a greenhouse gas, the generated greenhouse effect is 25-30 times of that of carbon dioxide, and the coalbed methane has dangers of explosion and outburst. In order to increase the energy utilization rate and reduce the occurrence of mine disaster, increase of the borehole gas extracting efficiency is very necessary. Borehole gas extraction is a major means for realizing reclamation of coal seam gas, and is also an important means for preventing gas disaster. In order to increase the borehole extracting efficiency of the coal seams, and reduce the dangers of gas explosion and outburst, it is very necessary to design and develop a method for extracting gas enhanced by coal seam fracturing, which has high safety, low cost and easy operation.

Most coal seams in China are characterized of having low-permeability, especially when mining is performed at a deep position, the permeability of the coal seams is poor. Therefore, the influence scope of common borehole gas extraction is limited, pressure relief is low, borehole flow is small and attenuation coefficient is large. In order to increase the extracting efficiency of the coal seam gas, pressure relief anti-reflection needs to be performed on the coal seams to increase the influence scope of the borehole gas extraction. The current coal seam pressure relief anti-reflection technology mainly includes a deep hole blasting technology. However, the deep hole blasting technology has certain dangers, and may cause accidents by misoperation because underground conditions are relatively complicated and changeable, especially the conditions inside deep holes.

SUMMARY OF THE INVENTION

Aiming at the deficiencies in the prior art that the influence scope of borehole gas extraction is limited, pressure relief is low, borehole gas flow is small, attenuation coefficient is great, risk is high, operation is complicated and the like, the present invention provides a method for extracting gas enhanced by fracturing a coal seam through multi-stage combustion impact wave in coal mine which has high safety, low cost and easy operation.

A specific technical scheme of the present invention is as follows:

A method for extracting gas by fracturing a coal seam through a combination of hydraulic slotting and multi-stage combustion impact wave includes the following steps:

S1: constructing an impact borehole in a coal seam, and cutting a large number of slots around the impact borehole by high-pressure water jet slotting equipment;

S2: placing a porous cylinder with a piston in the impact borehole, inserting one end of a gas injection and extraction pipe through the piston into the porous cylinder, extending the other end of the gas injection and extraction pipe out of the impact borehole; putting one end of an impact wave introduction pipe into the porous cylinder, and connecting the other end of the impact wave introduction pipe to a combustion chamber outside the impact borehole, wherein the impact wave introduction pipe does not pass through the piston;

S3: sealing the impact borehole, injecting $N_2$ (nitrogen gas) or $CO_2$ (carbon dioxide gas) into the impact borehole by the gas injection and extraction pipe, and then closing the gas injection pipe;

S4: injecting combustible gas and auxiliary gas into the combustion chamber;

S5: igniting the combustible gas in the combustion chamber by a control system, wherein impact wave generated by combustion of the combustible gas is introduced into the porous cylinder by the impact wave introduction pipe to impact the piston, and the piston slides along the gas injection and extraction pipe to squeeze $N_2$ or $CO_2$ in the impact borehole, so that a large number of fractures are generated around the impact borehole under guiding action of the slots;

S6: opening the gas injection and extraction pipe to continuously inject $N_2$ or $CO_2$ into the impact borehole to squeeze the piston to reset the piston and then closing the gas injection and extraction pipe; and S7: repeating steps S5 and S6, and compacting and compressing $N_2$ or $CO_2$ for multiple times to fracture the coal seam, so that fracture networks are formed on the coal seam around the impact borehole.

Further, step S1 specifically includes constructing the impact borehole and a common borehole in the coal seam, wherein the common borehole is located around the impact borehole; and step S2 specifically includes placing the porous cylinder with the piston in the impact borehole, inserting one end of the gas injection and extraction pipe through the piston into the porous cylinder, extending the other end of the gas injection and extraction pipe out of the impact borehole; putting one end of the impact wave introduction pipe into the porous cylinder, and connecting the other end of the impact wave introduction pipe to the combustion chamber outside the impact borehole, wherein the impact wave introduction pipe does not pass through the piston; putting one end of a common extraction pipe into the common borehole and sealing the borehole, and connecting the other end of the common extraction pipe to an extraction system.

Further, after step S7, the method also includes steps S8 of opening the gas injection and extraction pipe and connecting the gas injection and extraction pipe to the extraction system to perform gas extraction after the fracture networks are formed on the coal seam around the impact borehole.

Further, a solenoid valve is also provided on the impact wave introduction pipe, and the solenoid valve is set and regulated by the control system.

Further, the opening pressure value of the solenoid valve is 30 MPa.

Further, the combustible gas is methane, and the auxiliary gas is dry air.

Compared with the prior art, the present invention has the following beneficial effects: by adopting the method for extracting gas by fracturing a coal seam through a combination of hydraulic slotting and multi-stage combustion impact wave, high-temperature and high-pressure impact wave generated by mixed combustion of the methane and the dry air in the high-temperature and high-pressure combustion chamber impacts the piston in multiple stages to squeeze $N_2$ or $CO_2$, so that a large number of fractures are generated around the impact borehole under the guiding action of the slots and the original fracture aperture is enlarged, and the connectivity of the fracture networks is intensified; the slots are cut in the borehole by the hydraulic slotting technology, pressure relief anti-reflection is performed on the coal seam and the $N_2$ or $CO_2$ storage space is enlarged; by performing multi-stage impacting, compressing and fracturing on the coal seam around the impact borehole, the original fracture aperture is enlarged, the connectivity of the fracture networks in the coal seam is intensified, and the pressure relief scope of the extracting borehole is remarkably extended; after the high-temperature and high-pressure impact wave impacts the piston, residual high-temperature and high-pressure impact wave also promotes desorption and flow of the gas of the coal seam, so as to better promote the gas extracting efficiency of the borehole; and the method and the equipment are high in safety, low in cost, and easy to operate, and meanwhile are applicable to pressure relief anti-reflection of coal mine crossing borehole and bedding borehole, and are wide in application scope.

BRIEF DESCRIPTION OF THE DRAWINGS

FIG. 1 is a schematic diagram of structure of an equipment used by the method for extracting gas by fracturing the coal seam through the combination of hydraulic slotting and multi-stage combustion impact wave in embodiment 1 of the present invention and a mounting position thereof.

In FIG. 1, 1: high-temperature and high-pressure combustion chamber, 2: dry air cylinder, 3: methane cylinder, 4: control system, 5: solenoid valve, 6: gas injection and extraction pipe, 7: valve, 8: impact wave introduction pipe, 9: porous cylinder, 10: common extraction pipe.

DETAILED DESCRIPTION OF THE INVENTION

Further description of the present invention are made in the following by referring to the accompanying drawings.

Embodiment 1

As shown in FIG. 1, coal mine underground multi-stage combustion impact wave coal seam fracturing intensified gas extracting equipment includes a porous cylinder 9 with a piston, a gas injection and extraction pipe 6, a common extraction pipe 10, an impact wave introduction pipe 8, and a combustion impact device.

One end of the gas injection and extraction pipe 6 penetrates through the piston in the porous cylinder 9 and extends into the porous cylinder 9, the other end of the gas injection and extraction pipe 6 extends out of the porous cylinder 9, the piston slides on the gas injection and extraction pipe 6, and a valve 7 is mounted on the gas injection and extraction pipe 6. One end of the impact wave introduction pipe 8 is connected with the combustion impact device, and the other end of the impact wave introduction pipe extends into the porous cylinder and does not pass through the piston. The common extraction pipe 10 is connected with an extraction system.

The combustion impact device includes a high-temperature and high-pressure combustion chamber 1, a first gas injection pipe, a second gas injection pipe and a control system 4. One end of the first gas injection pipe and one end of the second gas injection pipe are respectively connected with the high-temperature and high-pressure combustion chamber 1, and the other end of the first gas injection pipe and the other end of the second gas injection pipe are respectively connected with a methane cylinder 3 and a dry air cylinder 2. An ignition device of the control system 4 extends into the combustion chamber, the first gas injection pipe is used for injecting methane into the high-temperature and high-pressure combustion chamber 1, the second gas injection pipe is used for injecting dry air into the high-temperature and high-pressure combustion chamber 1, and the control system 4 is used for igniting the methane in the high-temperature and high-pressure combustion chamber 1. A solenoid valve 5 is mounted on the impact wave introduction pipe 8, and is controlled by the control system 4.

Embodiment 2

The method for extracting gas enhanced by fracturing the coal seam through multi-stage combustion impact wave in coal mine underground using the equipment in embodiment 1 specifically includes the following steps:

a. constructing a common borehole and an impact borehole alternately in a coal seam, wherein the common borehole is located around the impact borehole; and cutting a large number of slots around the impact borehole by high-pressure water jet slotting equipment;

b. after construction is completed, placing a porous cylinder 9 with a piston in the impact borehole, wherein the cylinder wall of the porous cylinder 9 is tightly adhered to the impact borehole;

c. placing a gas injection and extraction pipe 6 in the porous cylinder 9, then placing the gas injection and extraction pipe 6 and the porous cylinder 9 in the impact borehole together, tightly connecting an impact wave introduction pipe 8 with the piston, and then performing borehole sealing operation; after the borehole sealing operation is completed, connecting the common extraction pipe 10 to the extraction system to extract gas; and then setting the opening pressure value of a solenoid valve 5 as 30 MPa by the control system 4;

d. injecting a large amount of $N_2$ or $CO_2$ into the impact borehole via the gas injection and extraction pipe 6 by using a high pressure gas cylinder and a pressure reducing valve, then closing the valve 7 on the gas injection and extraction pipe 6 and connecting the gas injection and extraction pipe 6 to a pipe network of the extraction system;

e. injecting a certain amount of dry air and methane into a high-temperature and high-pressure combustion chamber 1 by a methane cylinder 3, a dry air cylinder 2 and the pressure reducing valve, and igniting the mixed gas by the control system 4;

f. after the pressure in the high-temperature and high-pressure combustion chamber 1 reaches 30 MPa, instantly releasing the high-temperature and high-pressure impact wave by the automatic start of the solenoid valve 5, and impacting the piston by the impact wave introduction pipe 8, wherein the piston slides along the gas injection and extraction pipe 6 to squeeze $N_2$ or $CO_2$, and further a large number of fractures are generated around the impact borehole under the guiding action of the slots, and the original fracture aperture is enlarged, so as to intensify the connectivity of the fracture network;

g. opening the valve of the gas injection and extraction pipe, injecting a large amount of $N_2$ into the impact borehole by the gas injection and extraction pipe to squeeze the piston, so that the piston resets to the original position, and then closing the valve;

h. repeating steps e-g, and impacting and compressing $N_2$ or $CO_2$ in multiple stages to fracture the coal seam, so that more fracture networks are formed on the coal seam around the impact borehole; and i. after temperature in the borehole is reduced, opening the valve 7 on the gas injection and extraction pipe 6, and starting the extraction system to perform gas extraction by the gas injection and extraction pipe 6 and the common extraction pipe 10.

What is claimed is:

1. A method for extracting gas by fracturing a coal seam through a combination of hydraulic slotting and multi-stage combustion impact wave, comprising the following steps:

S1: constructing an impact borehole in a coal seam, and cutting a number of slots around the impact borehole by a high-pressure water jet slotting equipment;

S2: placing a porous cylinder with a piston in the impact borehole, inserting one end of a gas injection and extraction pipe through the piston into the porous cylinder, extending the other end of the gas injection and extraction pipe out of the impact borehole; putting one end of an impact wave introduction pipe into the porous cylinder, and connecting the other end of the impact wave introduction pipe to a combustion chamber outside the impact borehole, wherein the impact wave introduction pipe does not pass through the piston;

S3: sealing the impact borehole, injecting $N_2$ (nitrogen gas) or $CO_2$ (carbon dioxide gas) into the impact borehole by the gas injection and extraction pipe, and then closing the gas injection and extraction pipe;

S4: injecting combustible gas and auxiliary gas into the combustion chamber;

S5: igniting the combustible gas in the combustion chamber by a control system, wherein impact wave generated by combustion of the combustible gas is introduced into the porous cylinder by the impact wave introduction pipe to impact the piston, and the piston slides along the gas injection and extraction pipe to squeeze the $N_2$ or $CO_2$ in the impact borehole, so that a number of fractures are generated around the impact borehole under guiding action of the slots;

S6: opening the gas injection and extraction pipe to continuously inject $N_2$ or $CO_2$ into the impact borehole to squeeze the piston to reset the piston and then closing the gas injection and extraction pipe; and S7: repeating steps S5 and S6 to impact and compress $N_2$ or $CO_2$ for multiple times to fracture the coal seam, so that fracture networks are formed on the coal seam around the impact borehole.

2. The method for extracting the gas by fracturing the coal seam through the combination of the hydraulic slotting and the multi-stage combustion impact wave according to claim 1, wherein the step S1 further comprises constructing the impact borehole and a common borehole in the coal seam, wherein the common borehole is located around the impact borehole; and the step S2 further comprises putting one end of a common extraction pipe into the common borehole and sealing the common borehole, and connecting the other end of the common extraction pipe to an extraction system.

3. The method for extracting the gas by fracturing the coal seam through the combination of the hydraulic slotting and the multi-stage combustion impact wave according to claim 2, wherein the method also comprises step S8 of opening the gas injection and extraction pipe and connecting the gas injection and extraction pipe to the extraction system to perform gas extraction after the fracture networks are formed on the coal seam around the impact borehole.

4. The method for extracting the gas by fracturing the coal seam through the combination of the hydraulic slotting and the multi-stage combustion impact wave according to claim 1, wherein the impact wave introduction pipe is also provided with a solenoid valve, and the solenoid valve is set and regulated by the control system.

5. The method for extracting the gas by fracturing the coal seam through the combination of the hydraulic slotting and the multi-stage combustion impact wave according to claim 4, wherein the solenoid valve has an opening pressure value of 30 MPa.

6. The method for extracting the gas by fracturing the coal seam through the combination of the hydraulic slotting and the multi-stage combustion impact wave according to claim 1, wherein the combustible gas is methane, and the auxiliary gas is dry air.

* * * * *